US008138689B2

(12) United States Patent
Adenau

(10) Patent No.: US 8,138,689 B2
(45) Date of Patent: Mar. 20, 2012

(54) LIGHTING CONTROL CONSOLE FOR CONTROLLING A LIGHTING SYSTEM

(75) Inventor: Michael Adenau, Würzburg (DE)

(73) Assignee: MA Lighting Technology GmbH, Waldbüttelbrunn (DE)

( * ) Notice: Subject to any disclaimer, the term of this patent is extended or adjusted under 35 U.S.C. 154(b) by 449 days.

(21) Appl. No.: 12/361,078

(22) Filed: Jan. 28, 2009

(65) Prior Publication Data

US 2010/0188025 A1 Jul. 29, 2010

(51) Int. Cl.
*H05B 37/02* (2006.01)

(52) U.S. Cl. ..... 315/318; 315/292; 315/294; 315/312

(58) Field of Classification Search ..... 315/312, 315/316–318, 292–294
See application file for complete search history.

(56) References Cited

U.S. PATENT DOCUMENTS 6,812,653 B2 * 11/2004 Bellivean ..... 315/318
7,885,961 B2 * 2/2011 Horowitz et al. ..... 707/737

* cited by examiner

*Primary Examiner* — Shawki S Ismail
*Assistant Examiner* — Christopher Lo
(74) *Attorney, Agent, or Firm* — Schwegman, Lundberg & Woessner, P.A.

(57) ABSTRACT

Embodiments of the invention relate to a lighting control console for controlling a lighting system, wherein digital control commands are generated in the lighting control console and can be transmitted via data links to the lighting devices of the lighting system, and wherein the lighting control console includes at least one housing, in which the hardware components are arranged with protection against external influences, and wherein the lighting control console includes a plurality of operating elements, particularly keys, slide controls and/or rotary controls, which are arranged on the upper side of the housing and may be used for entering operating commands, and wherein the lighting control console includes at least one display device on which a user interface can be displayed.

13 Claims, 13 Drawing Sheets

LIGHTING CONTROL CONSOLE FOR CONTROLLING A LIGHTING SYSTEM

The invention relates to a lighting control console for controlling a lighting system in accordance with the preamble of claim 1.

Generic lighting control consoles are used for controlling lighting systems such as are used for example in theaters or on concert stages. These lighting systems normally include a large number of lighting devices, such as spotlights, and in their turn the lighting devices themselves can be switched between a wide variety of lighting states, for example different colors. The various lighting devices with their different lighting states are controlled by programmed parameters in the lighting software of the lighting control console.

Conventional lighting systems in this context may include as many as several thousand lighting devices. The lighting control consoles provided to control the lighting devices have a housing which accommodates the electronic hardware essential for carrying out its function and protects it from external influences. A microcontroller, for example a complex digital processor that allows for digital data and signal processing, is usually located in the housing to control these complex lighting systems. Operating elements such as keys, slide controls and/or rotary controls are also provided on the housing to enable the operator to enter commands. The lighting control consoles are usually equipped with a display device as well, for example a color monitor, so that a user interface can be displayed.

The operating commands are entered via the operating elements by the operator in order to program the lighting software or to control the lighting software during a concert or theatrical performance. These operating commands may for example consist of selecting a certain lighting device or adjusting a certain lighting parameter. The operating commands assigned to the individual operating elements on the lighting control console may be altered by switching the menus concerned so that correspondingly complex lighting programs may be configured and controlled.

Lighting control consoles with an extremely variable scope of functions and performance are known from the related art. For example, there are small lighting control consoles with a relatively simple design, which may be used to control the lighting systems on smaller stages. These small lighting control consoles are only equipped with a relatively small number of operating elements and often with only one display device. At the other end of the scale, lighting control consoles for controlling extremely complex lighting systems, such as are used for television presentations, are also known. These large lighting control consoles are equipped accordingly with several display devices and a very large number of operating elements, such as pushbuttons, slide controls and/or rotary controls. Even the scope of performance and function of the hardware, which is otherwise still present in the lighting control console, is usually altered to match the performance and function capabilities listed in the specification for the control console.

In known lighting control consoles, specific hardware is selected depending on the size, that is to say the desired scope of performance and function, and the lighting control console is built up on the basis of this hardware. The disadvantage of this hardware topology being dependent on the scope of performance and function is that the lighting control consoles of each different performance and function class are configured entirely differently, so that very little or no synergies can be derived from common components.

Based on this prior art, the object of the present invention is therefore to suggest a novel lighting control console for controlling lighting systems, wherein lighting control consoles of different performance and function classes may be configured with the use of a large number of common components.

This object is achieved with a lighting control console as recited in the teaching of claim 1.

Advantageous embodiments of the invention are described in the subordinate claims.

The lighting control console according to the invention is based on the underlying idea that each lighting control console consists of at least two console modules. For their part, the console modules are characterized in that they consist of a hardware core and a hardware periphery. The electronic components of the hardware core in all console modules are essentially identical in construction, which provides the opportunity for deriving synergies from common components. On the other hand, the hardware components of the hardware periphery may be selected and installed individually for each console to enable the lighting control console to be adapted to a range of requirement profiles. As a result, a completely new kind of hardware topology for constructing lighting control consoles is suggested with the lighting control console according to the invention, and this novel hardware topology enables lighting control consoles to be constructed using a large number of common parts that are available at low cost.

It is essentially immaterial which identically constructed electronic components belong to the hardware core and thus figure in all console modules of the lighting control console. At all events, according to a preferred embodiment, the microcontroller, particularly the digital processor for generating and propagating adjustment commands in the lighting control console, belongs to the hardware core. Accordingly, this means that the lighting control console contains a number of microcontrollers or digital processors corresponding to the number of console modules provided in the lighting control console. For example, if the lighting control console is constructed from three console modules, the lighting control console possesses a total of three central processors for processing the control commands.

Besides the use of identically constructed microcontrollers in all console modules, it is also particularly advantageous if the hardware core also includes the digital memories for storing control commands, a control command data interface for exchanging control command data with the lighting devices, a transfer data interface for exchanging transfer data with the other console modules and/or a display device of identical construction, each with an assigned graphics processor for processing video signals.

It is particularly advantageous if the transfer data interface is configured in the manner of a network interface, particularly an Ethernet network interface. The result of this is that a data network over which the console modules exchange the transfer data with each other may be created from the various console modules of the lighting control console.

A particularly simple and inexpensive hardware setup for designing the lighting control console is obtained if the graphics processor that belongs to the hardware core and which calculates the video signals for the display device belonging to the hardware core is integrated in the digital processor for generating and managing the control commands, which also belongs to the hardware core. Hybrid microprocessors of such kind, which may be used as digital processors for calculating and managing control commands and for calculating graphics all at the same time, are inexpensive and have excellent potential for ensuring cost synergy in the hardware core of the console modules. In this case the digital processors with integrated graphics processor must be equipped with a display interface to which the display device may be connected.

The display device belonging to the hardware core of the console modules should preferably be constructed in the manner of a VGA monitor with a minimum resolution of 640×480 pixels. TFT flat panel monitors, particularly LCD flat panel monitors, are very well suited for integration in the console modules. Since each console module is equipped with at least one monitor designed as a common part when the display device is integrated in the hardware core, corresponding price advantages are achieved.

It is also particularly advantageous if the display device that is integrated in the hardware core is designed in the manner of a touch-sensitive sensor monitor (touch-screen).

It is essentially immaterial which hardware components are included in the hardware periphery, which may be composed variably in the console modules. It is particularly advantageous if the operating elements that may be used for entering control commands into the lighting control console, particularly keys, slide controls and/or rotary controls, belong to the hardware periphery. As a result, the user interface that is thus provided for entering control commands on each console module may be adapted simply to the respective scope of performance and function.

By combining console modules that are each equipped differently in terms of operating elements, a very large number of equipment variants may thus be created without excessive expense, and without the need for a correspondingly large number of different hardware components. In this context, it is particularly advantageous if the operating elements belonging to the hardware periphery are configured differently on at least two of the different console modules belonging to a lighting control console, so that the user interface provided by the operating elements may easily be varied correspondingly by exchanging the console modules used.

According to a preferred embodiment variant, a separate housing is provided for each of at least two of the console modules used in a lighting control console, and each such housing contains the hardware cores and hardware periphery of the two console modules. The lighting control console may then be assembled by combining these two housings, and the data is exchanged between the various console modules via corresponding data interfaces.

In order to be able to easily combine the different console modules of a lighting control console with each other, it is particularly advantageous if the housings of the respective console modules are equipped with corresponding coupling elements. The housings may be connected mechanically, and the lighting control console may thus be constructed mechanically by connecting the respective coupling elements with complementary function on adjacent console modules.

Depending on the scope of performance and function of the respective lighting control console, it is also particularly advantageous if data can be exchanged with a control computer via the transfer data interface of the console modules. In this case, this control computer is equipped with a further digital processor, which calculates data and exchanges this data with the digital processors in the console modules as transfer data via the transfer data interface. In order to be able to connect an external monitor to the external control computer, which exchanges the transfer data with the console modules, it is particularly advantageous if this control computer is also equipped with a separate video processor.

Various embodiments of the invention are shown diagrammatically in the drawing and will be explained for exemplary purposes in the following text:

IN THE DRAWING

Figure 1:
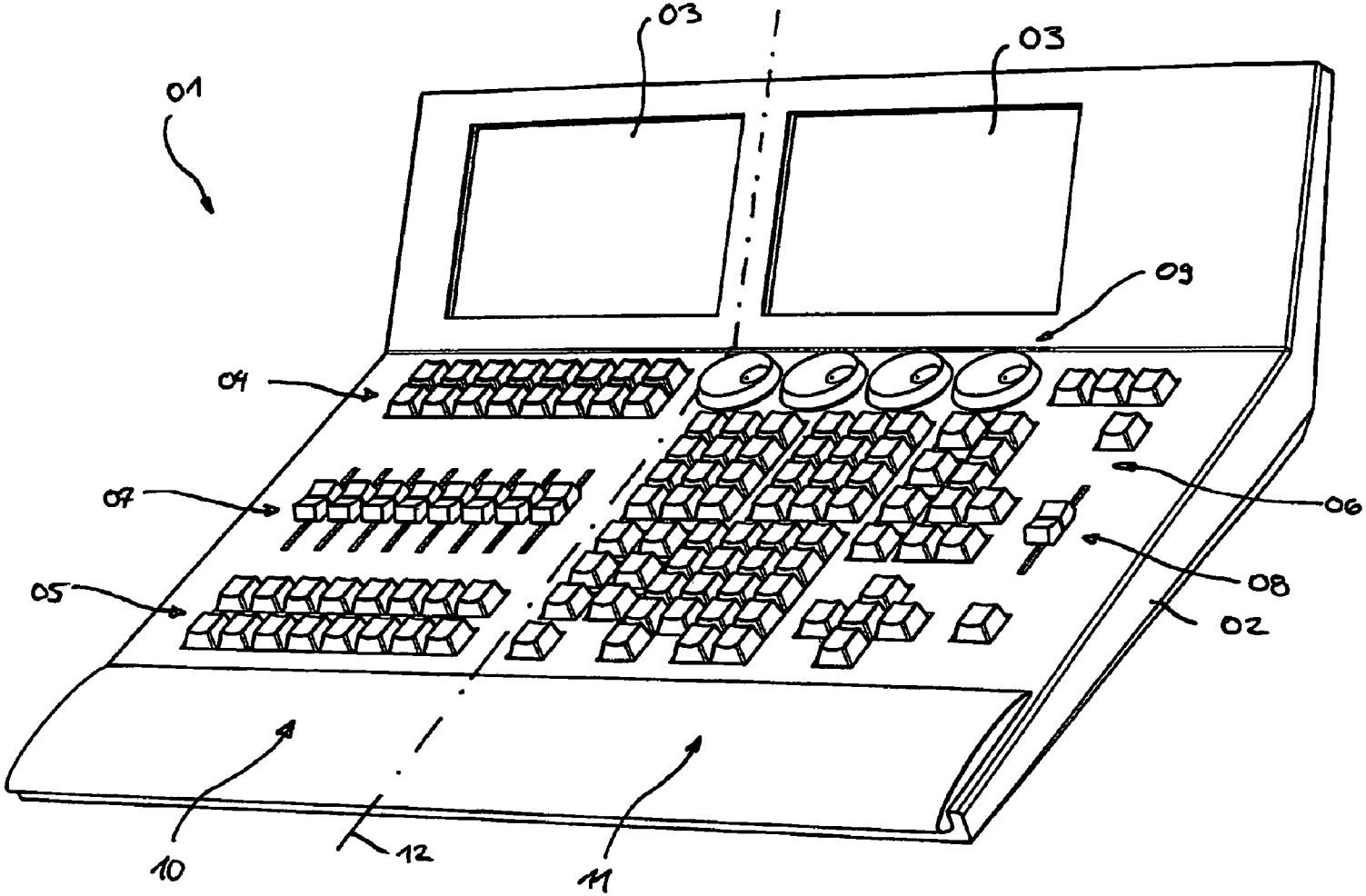
FIG. 1 is a perspective view of a lighting control console consisting of two console modules.

FIG. 1 shows a lighting control console 01 which is equipped with a housing 02, two display devices 03 of the touch-screen type, and a plurality of operating elements, including keys 04, 05 and 06, slide controls 07 and 08, and rotary controls 09. The lighting control console 01 is made up of two console modules 10 and 11, which are separated in the hardware topology and are located side by side in the housing 02. The spatial separation of the two console modules 10 and 11 is indicated by the dashed line 12 in FIG. 1.

Figure 2:
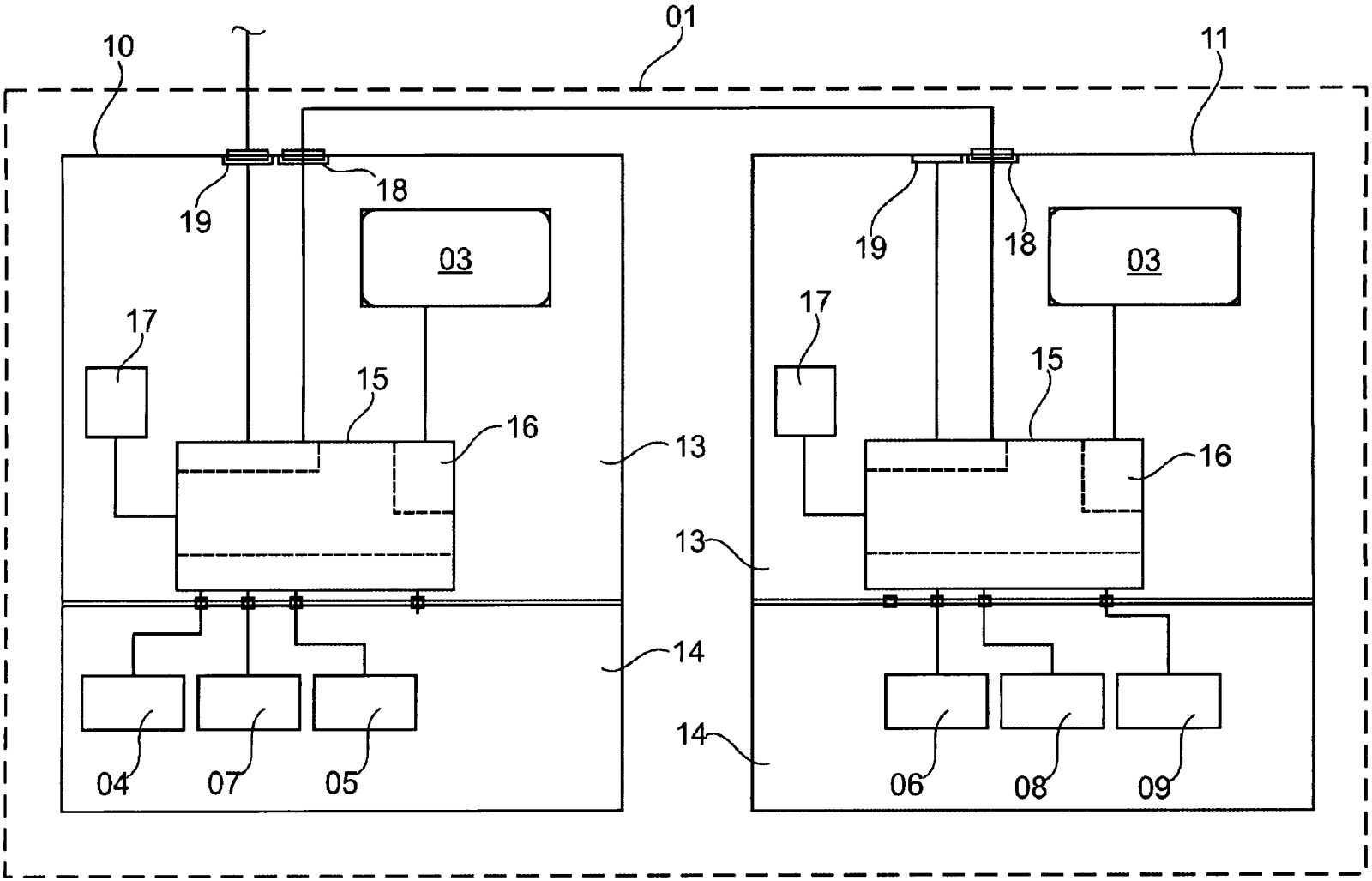
FIG. 2 is a diagrammatical view of the hardware topology of the lighting control console of FIG. 1.

FIG. 2 is a schematic representation of the hardware topology of the lighting control console 01 with the two console modules 10 and 11 arranged side by side. In their turn the two console modules 10 and 11 are each constructed from a hardware core 13, the two hardware cores being of identical construction, and from a hardware periphery 14 connected thereto, which may be adapted individually to each console module. In the embodiment shown, each hardware core 13 of the console modules 10 and 11 includes a digital processor 15 with integrated graphics processor 16, which calculates the video signals for the display device 03, which also belongs to the hardware core 13. Besides the aforementioned, each hardware core 13 of the console modules 10 and 11 also possesses a digital memory 17, a transfer data interface 18, via which the transfer data is exchanged between the individual console modules 10 and 11, and a control command data interface 19, at which control commands are output to the lighting devices connected to the lighting control console 01 in accordance with the DMX data protocol. In the embodiment shown in FIG. 2, a connection to the lighting devices is only connected to the control command data interface 19 of the console module 10, whereas the control command data interface 19 of the console module 11 is unoccupied. The control commands calculated in the console module 11 are therefore transmitted to the console module 10 via the transfer data interface 18, from where they are output to the lighting devices via the control command data interface 19.

The hardware periphery 14 of the console modules 10 and 11 may be configured differently in each case. In the embodiment shown, the hardware periphery 14 of the console module 10 contains the operating elements located in the console module 10, that is to say the keys 04, the slide controls 07 and the keys 05. On the other hand, the keys 06, the slide controls 08 and the rotary controls 09 are located in the hardware periphery 14 of the console module 11. If one considers the hardware topology of the lighting control console 01 shown in FIG. 2, it is clear that the scope of performance and function of the lighting control console 01 is achieved by using a large number of common components, in particular by using two identically constructed display devices 03, two identically constructed digital processors 15, each of which has an integrated graphics processor 16, two identically constructed digital memories 17, two identically constructed transfer data interfaces 18, and two identically constructed control command data interfaces 19. Only the hardware periphery 14 in each case, that is to say the keys 04 to 06, the slide controls 07 and 08, and the rotary controls 09, are different on the two console modules 10 and 11, in order provide a corresponding variety in operating elements for the lighting control console 01.

Figure 3:
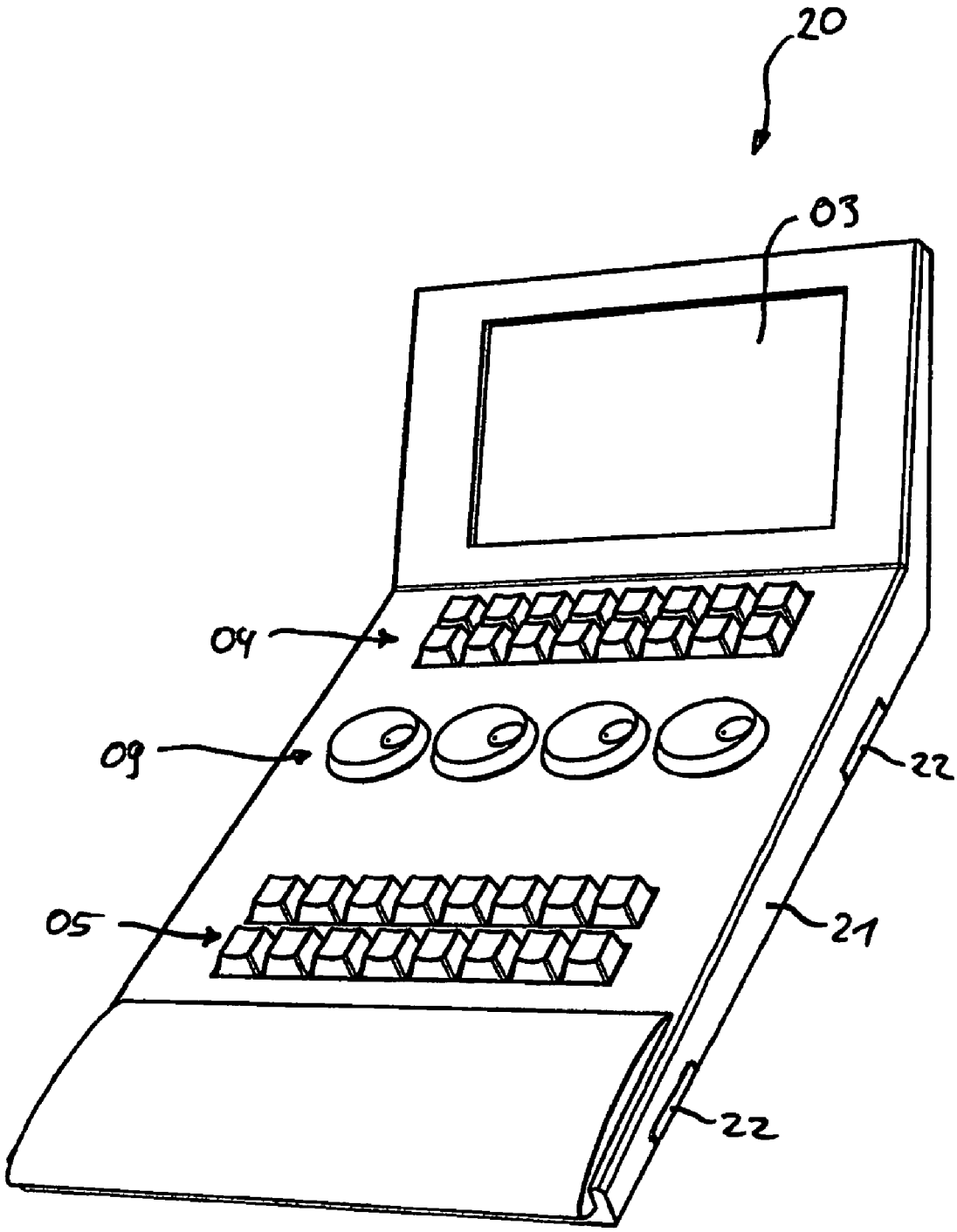
FIG. 3 shows another embodiment of a console module.

FIG. 3 shows a further variant of a console module 20. This console module 20 is accommodated in its own housing 21, the housing 21 having coupling elements 22, with which the housing 21 may be connected mechanically to the housings of other console modules or other lighting control consoles. The console module 20 is itself equipped with a display device 03, and is equipped with keys 04, keys 05 and rotary controls 09 as operating elements.

Figure 4:
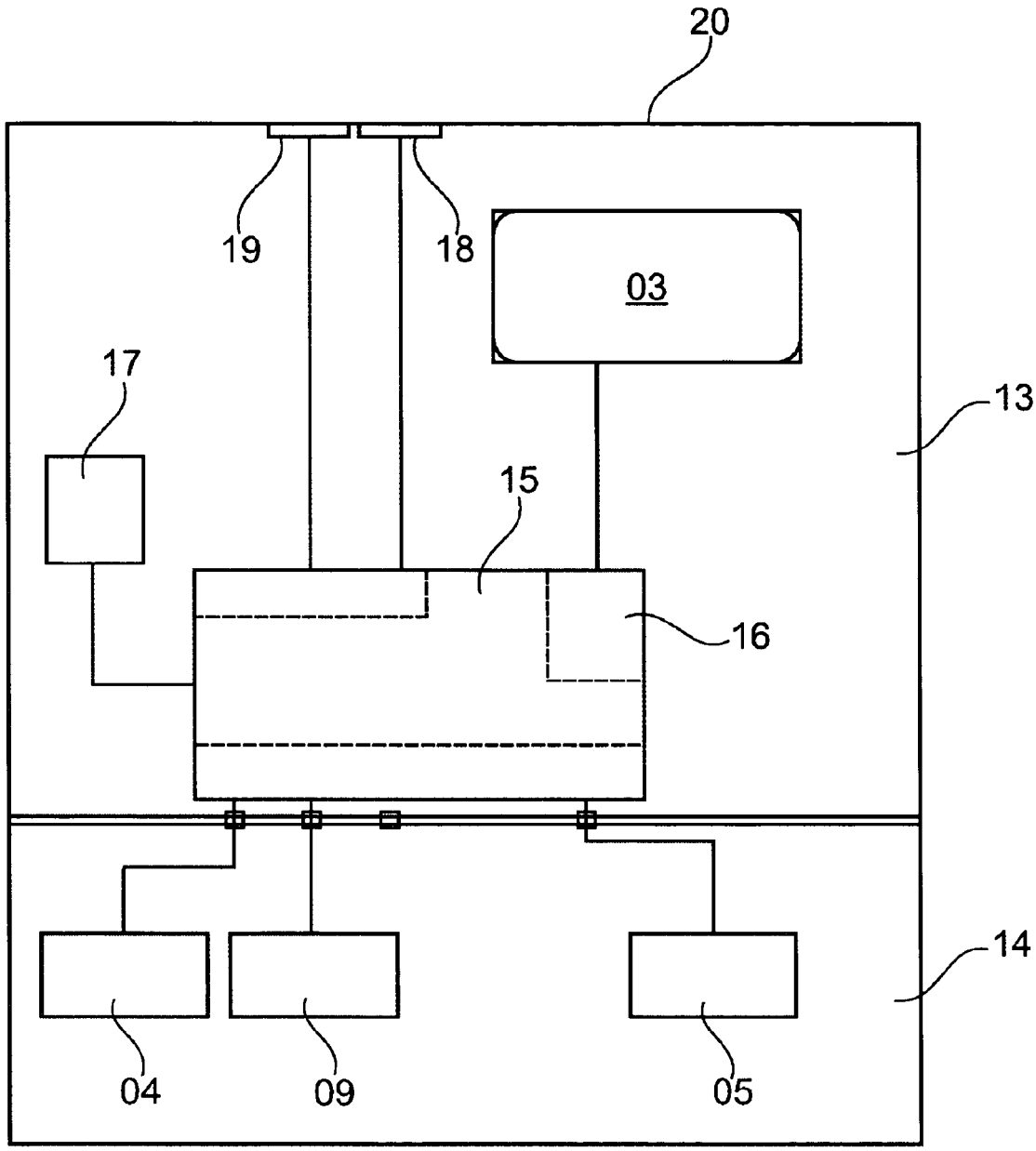
FIG. 4 is a diagrammatical view of the hardware topology of the lighting control console of FIG. 3.

FIG. 4 shows the hardware topology of the console module 20. This illustrates that the hardware core 13 of the console module 20 is of identical construction to the hardware core 13 of the console modules 10 and 11. As before, the hardware core 13 also includes the digital processor 15 with integrated graphics processor 16, the display device 03, the data memory 17, the transfer data interface 18 and the control command data interface 19. On the other hand, the hardware periphery 14 in the console module 20 includes the keys 04 and 05 and the rotary controls 09 instead of the slide controls 07 of the console module 10.

Figure 5:
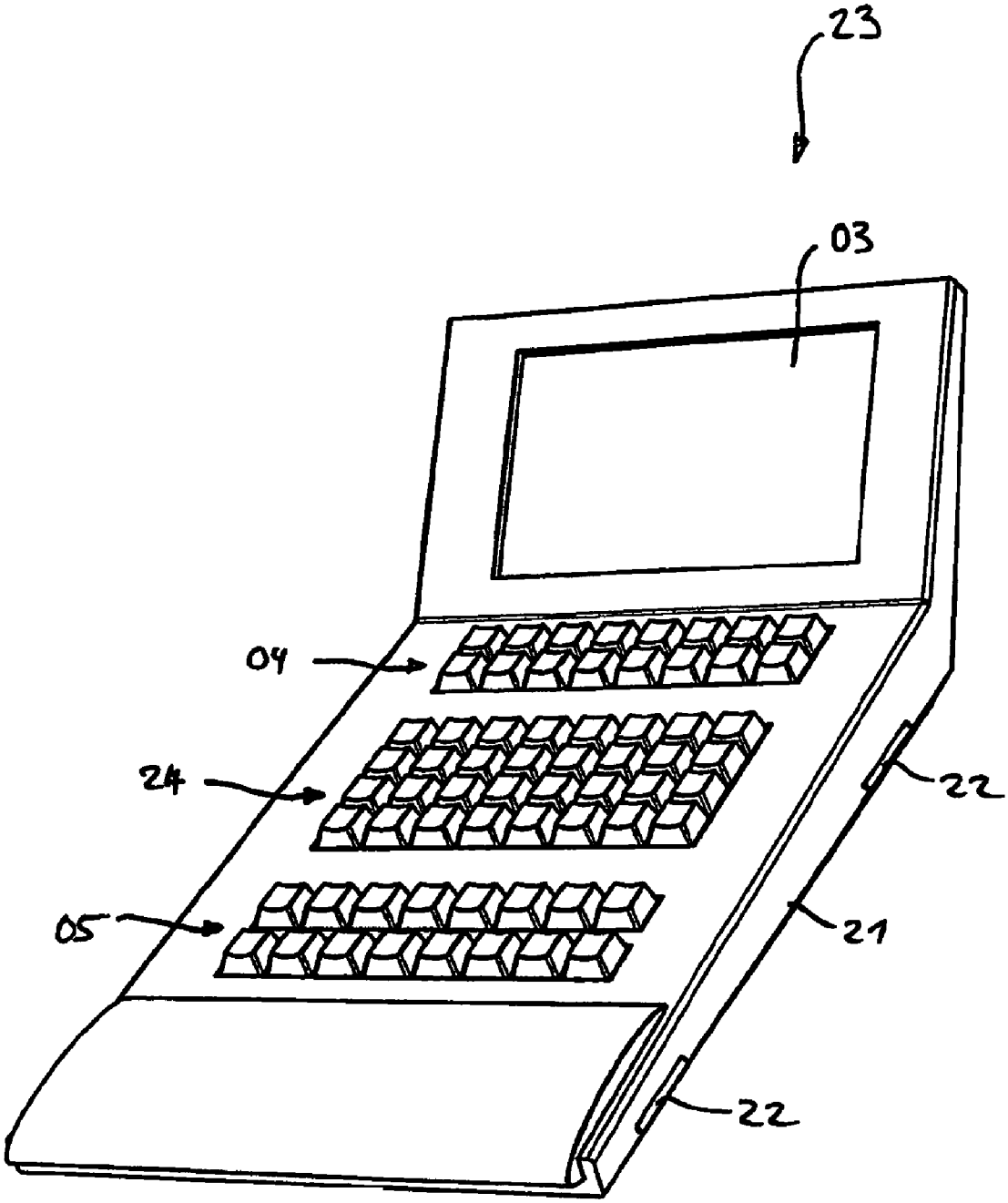
FIG. 5 is a perspective view of another embodiment of a console module.

FIG. 5 shows another embodiment variant of a console module 23, which is largely the same as the construction of the console module 20. In the console module 23, additional keys 24 are provided instead of the rotary controls 09.

Figure 6:
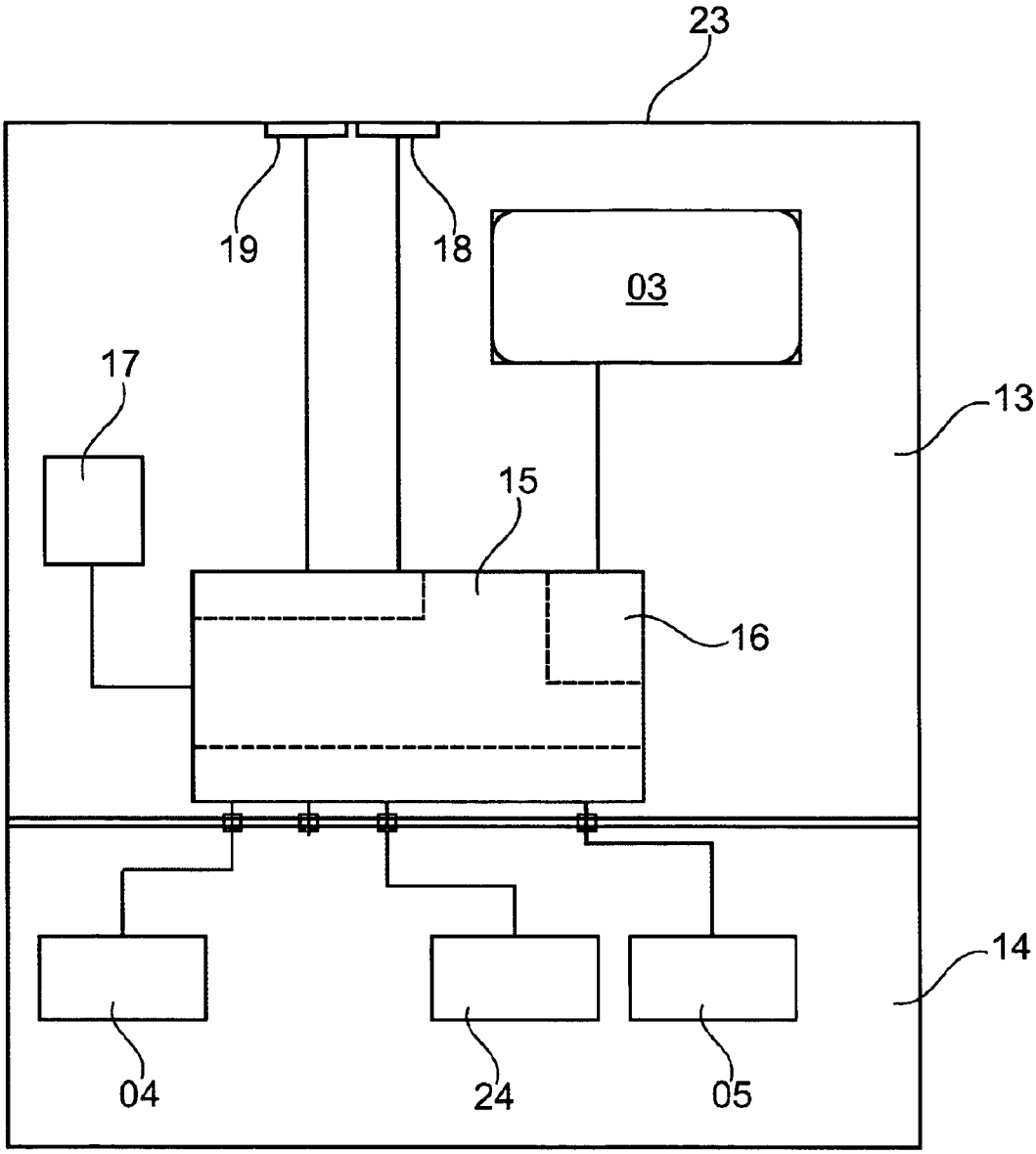
FIG. 6 is a diagrammatical view of the hardware topology of the console module of FIG. 5.

FIG. 6 shows the hardware topology of the console module 23, which also includes the identically constructed hardware core 13, but contains the keys 04 and 05 and the keys 24 in the hardware periphery 14.

Figure 7:
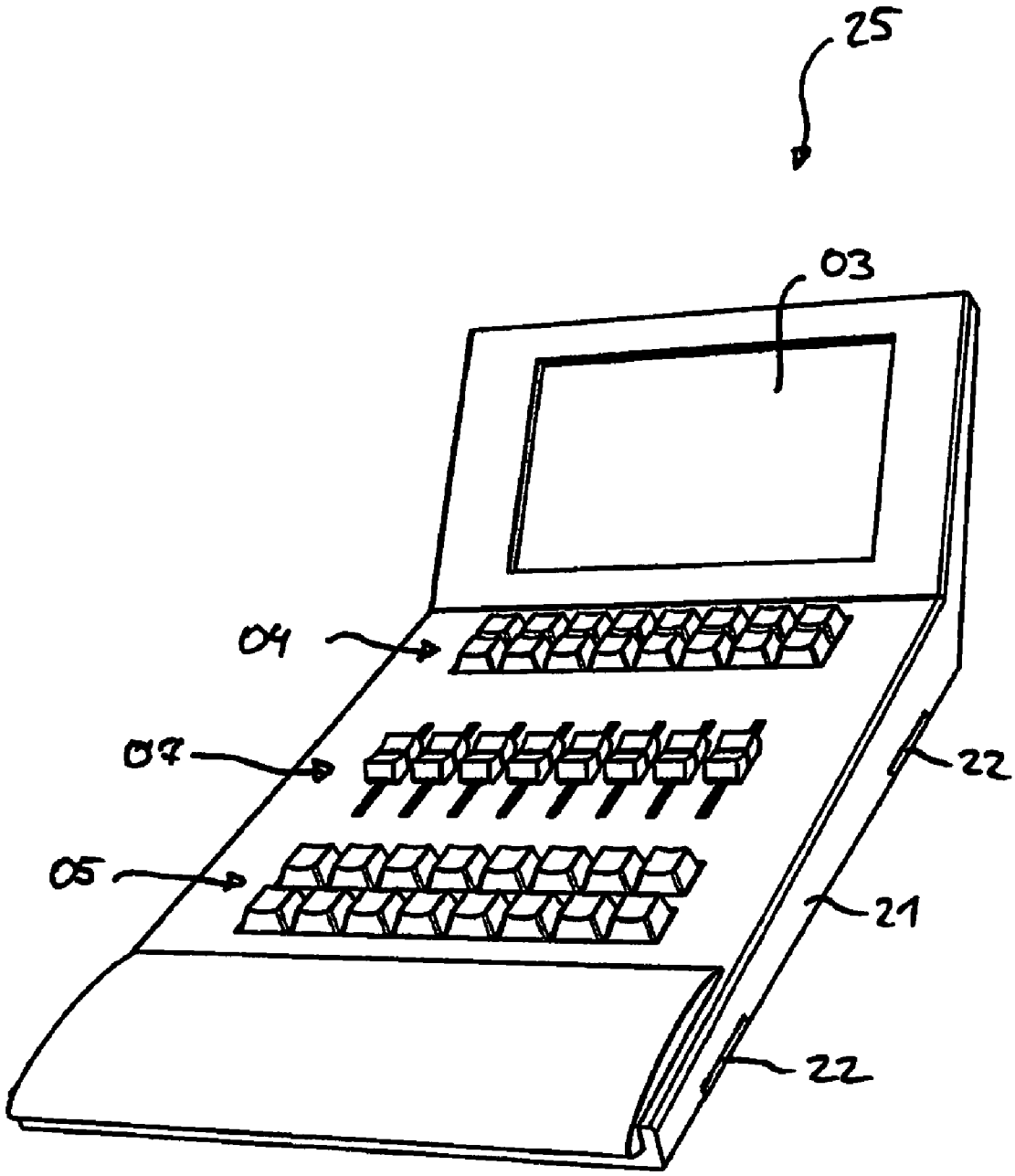
FIG. 7 is a perspective view of another embodiment of a console module.

FIG. 7 shows a third variant 25 of a console module, which also has essentially the same construction as the console module 20, but has slide controls 07 instead of the rotary controls 09.

Figure 8:
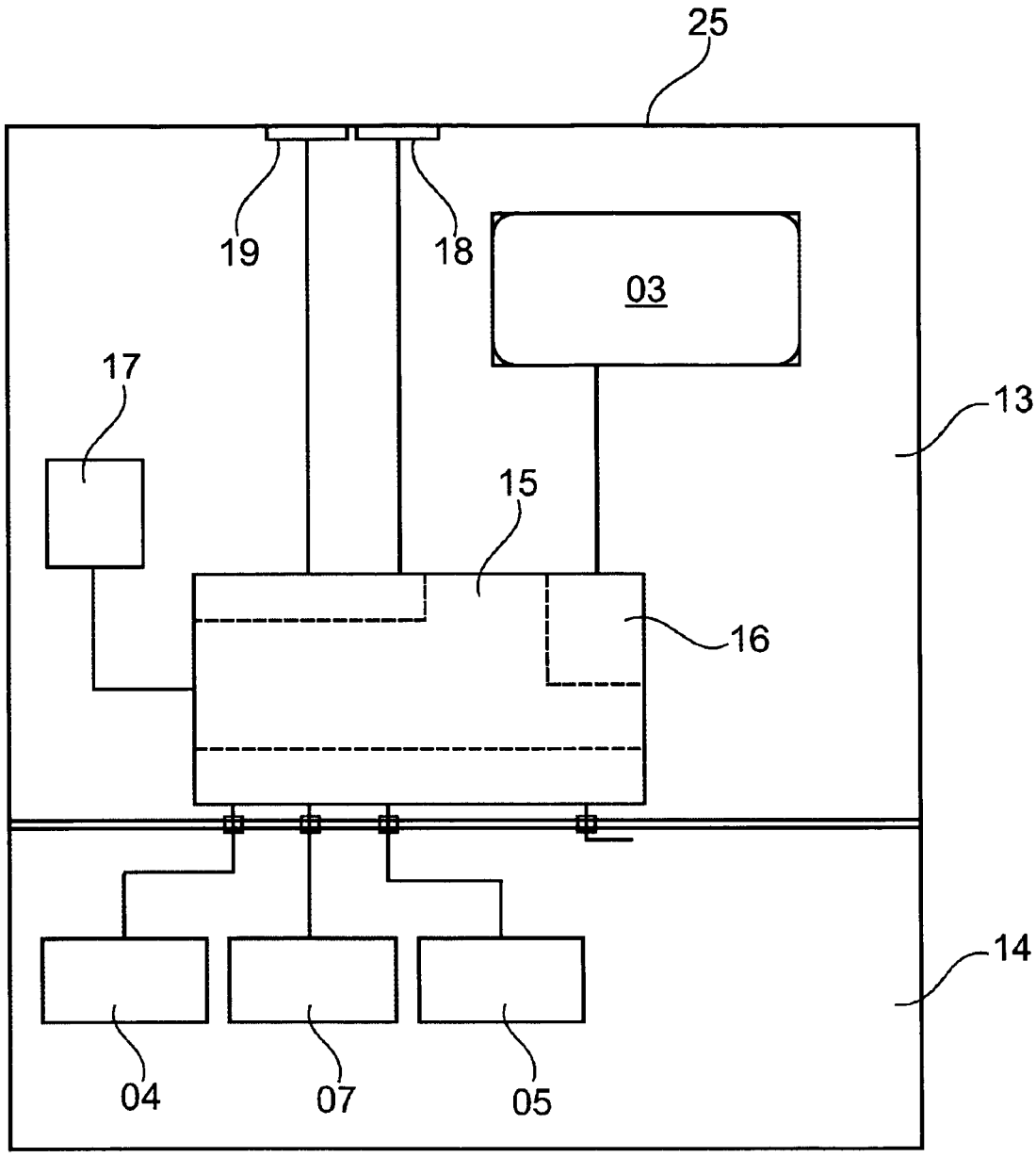
FIG. 8 is a diagrammatical view of the hardware topology of the console module of FIG. 7.

FIG. 8 shows the hardware topology of the console module 25, with the identically constructed hardware core 13 and the hardware periphery 14 specific to the individual console module, having the keys 04 and 05 as well as the slide controls 07.

Figure 9:
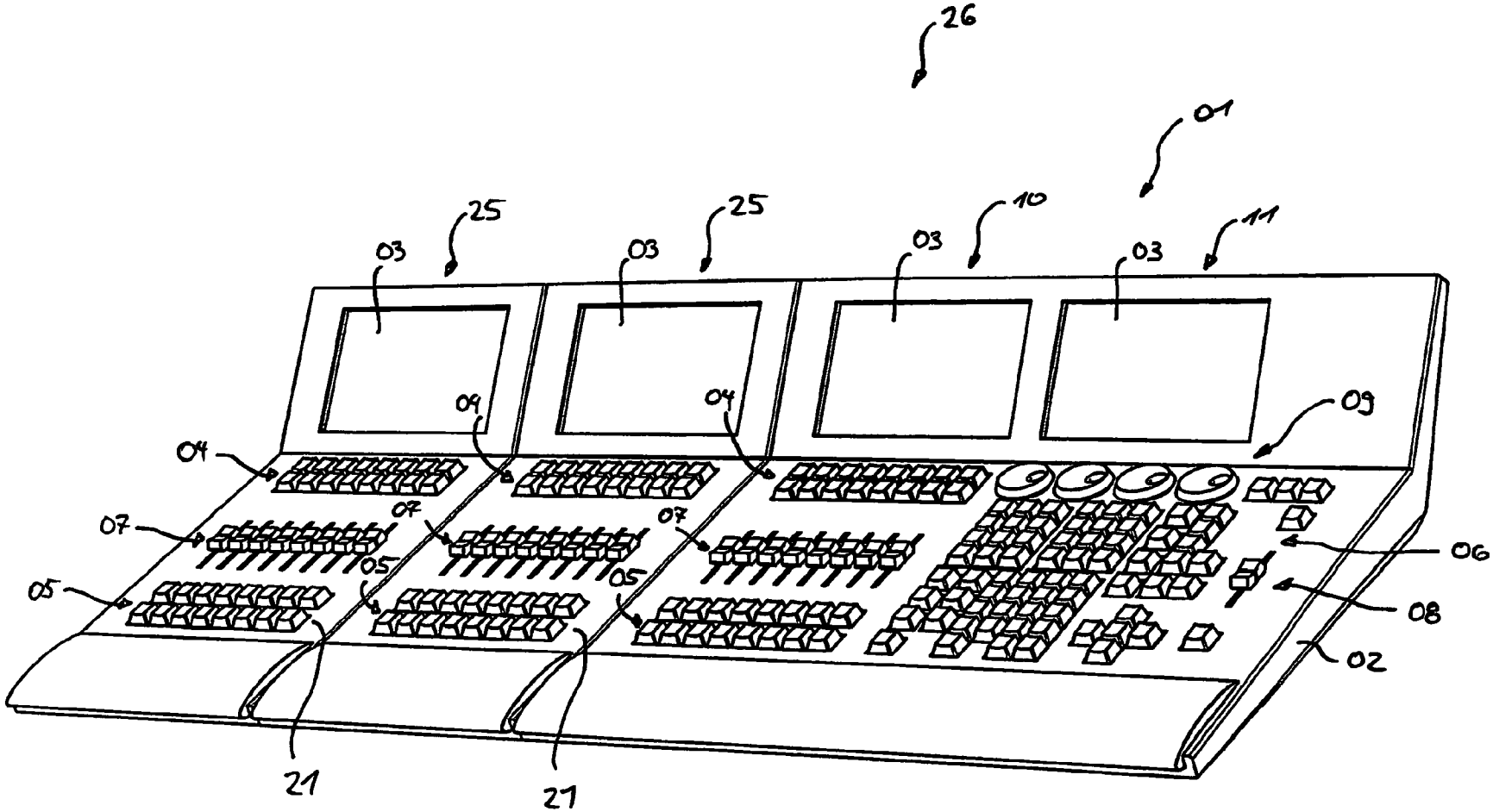
FIG. 9 is a perspective view of a lighting control console consisting of four console modules.

FIG. 9 shows a lighting control console 26 that is put together by combining the lighting control console 01 with two console modules 25. Overall, therefore, the lighting control console 26 besides the two console modules 25 also includes the two console modules 10 and 11.

Figure 10:
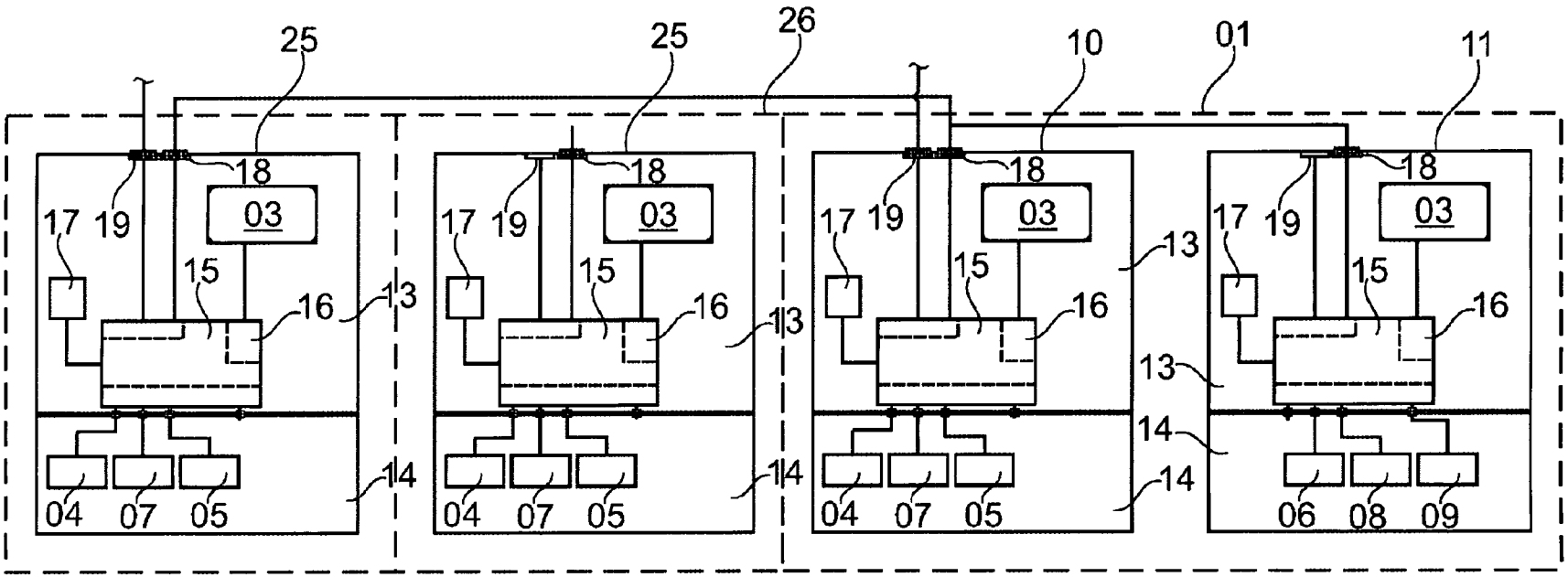
FIG. 10 shows the hardware topology of the lighting control console of FIG. 9.

FIG. 10 shows the hardware topology of the lighting control console 26. It may be seen that four identically constructed hardware cores 13 function together in the lighting control console 26, and they exchange data with each other via the transfer data interfaces 18. The hardware periphery 14 of the console modules 10 and 11 and of the two console modules 25 has been specifically adapted in this case.

Figure 11:
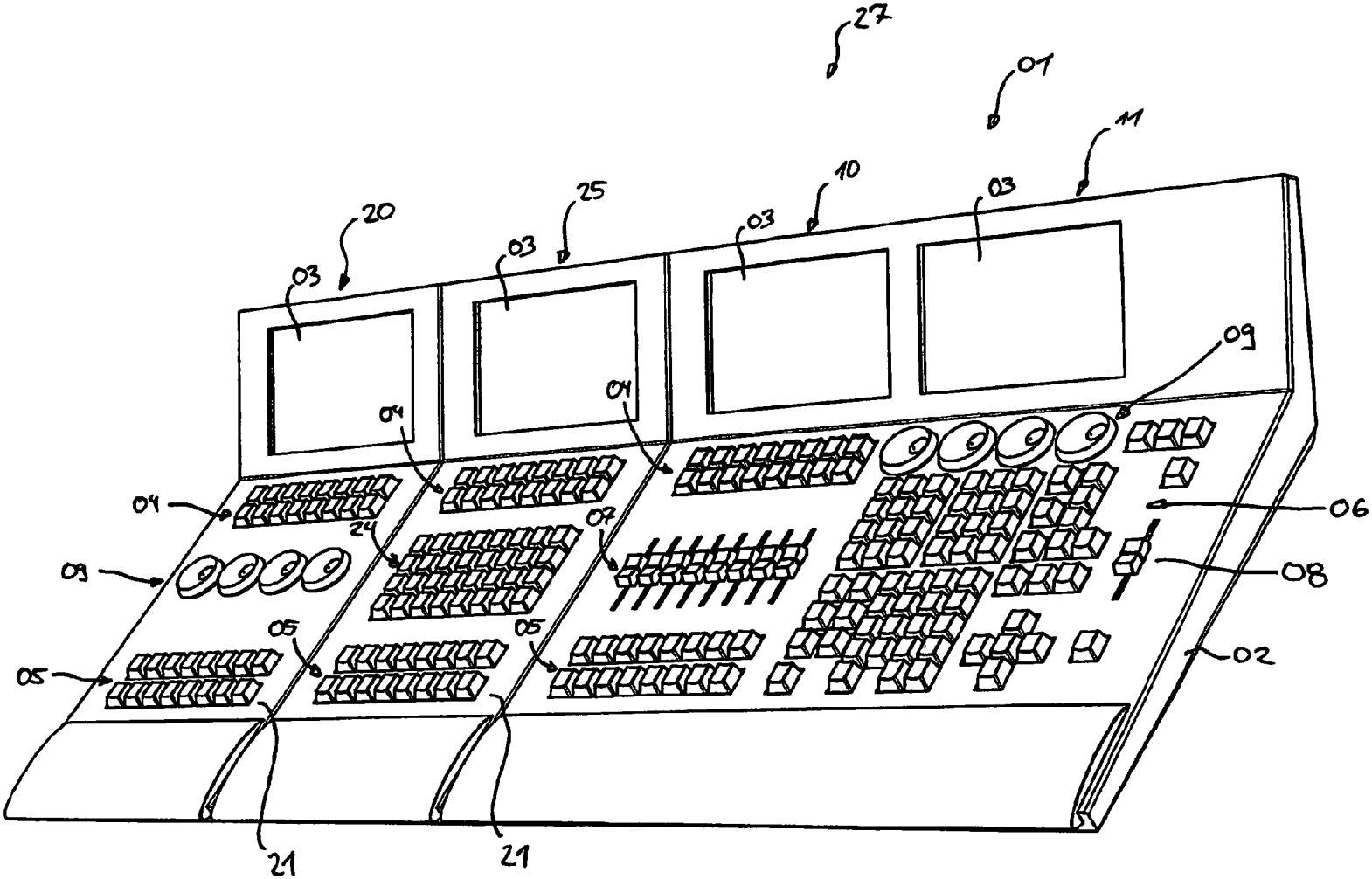
FIG. 11 is a perspective view of another embodiment of a lighting control console consisting of four console modules.

FIG. 11 shows a further variant 27 of a lighting control console that is formed by combining the lighting control console 01, which consists of the console modules 10 and 11, with a console module 20 and a console module 25.

Figure 12:
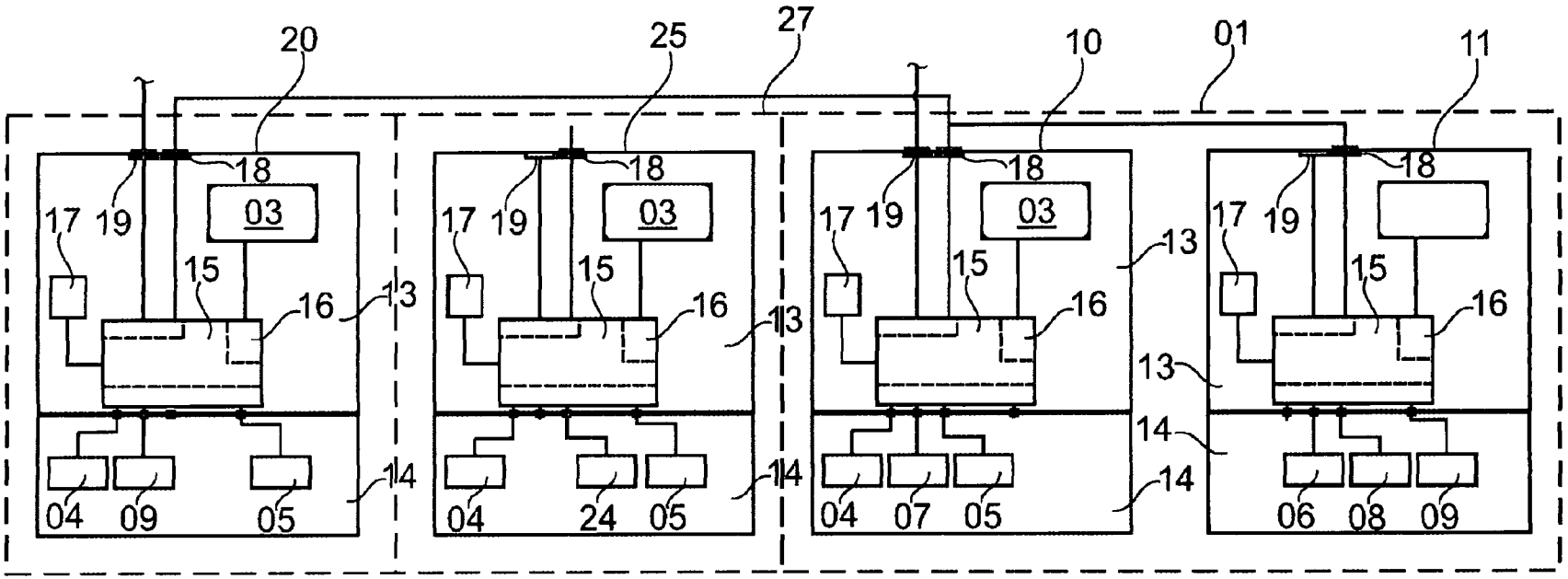
FIG. 12 is a diagrammatical view of the hardware topology of the lighting control console of FIG. 11.

FIG. 12 shows the hardware topology of the lighting control console 27 with the four console modules 10, 11, 20 and 25, each of which contains the hardware core 13 of identical construction.

Figure 13:
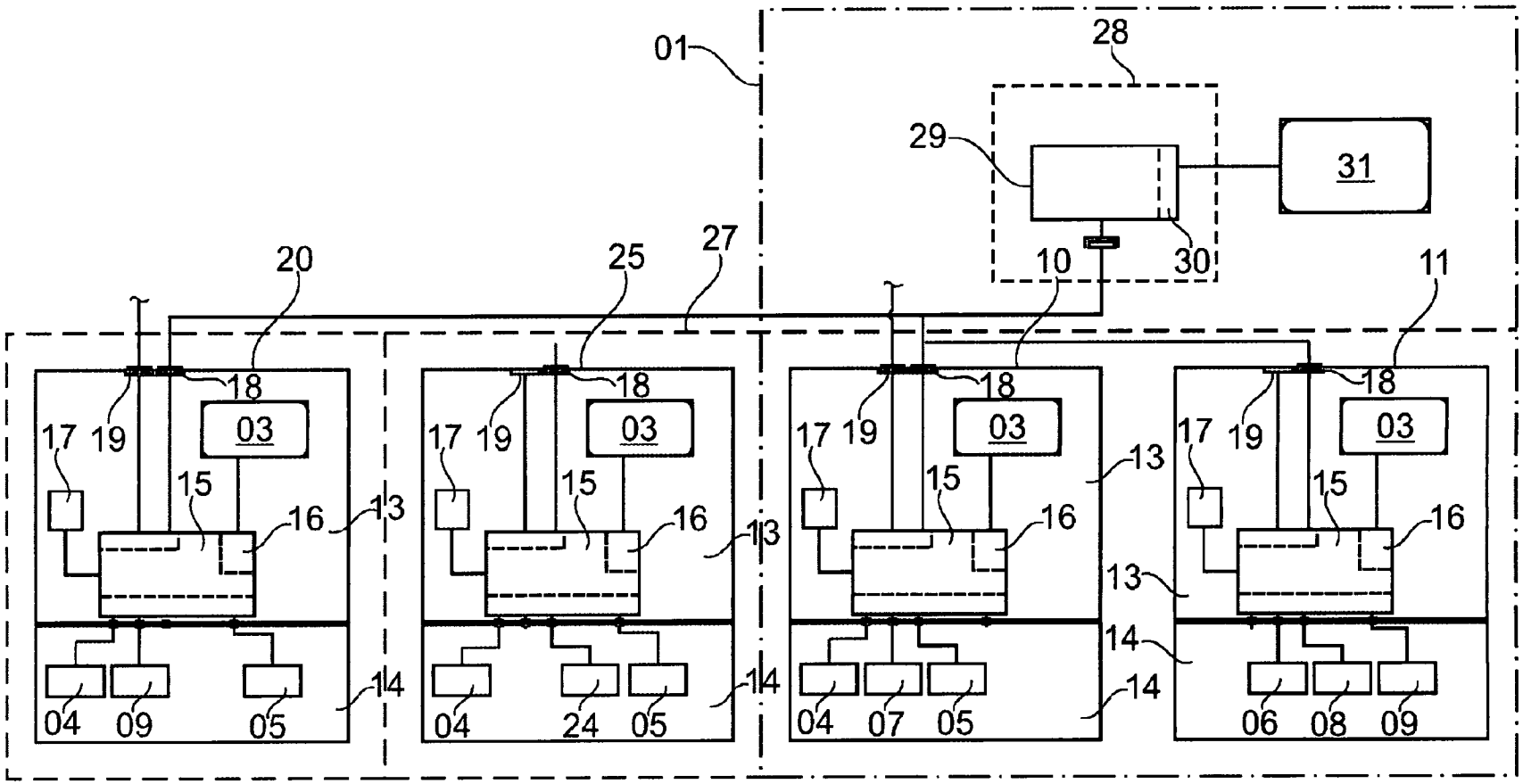
FIG. 13 shows the hardware topology of FIG. 12 with the addition of another control computer.

FIG. 13 shows the hardware topology of the lighting control console 27 as shown in FIG. 12, wherein an additional control computer 28 has been added to the lighting control console 27, which control computer exchanges data with the digital processors 15 in the console modules 10, 11, 20 and 25 via the transfer data interfaces 18. This transfer data is calculated in the digital processor 29 of the control computer. A graphics processor 30 is also integrated in the digital processor 29, which graphics processor calculates the video data for actuating a display device 31, for example a flat panel monitor. The control computer 28 with the graphics processor 30 may preferably be integrated in the housing of one of the console modules as well. In the embodiment shown in FIG. 13, the control computer 28 with the graphics processor 30 is integrated in the housing 02 of the lighting control console 01 that consists of the console modules 10 and 11.

The invention claimed is:

1. An apparatus comprising:

a lighting control console for controlling a lighting system, wherein one or more digital control commands are operable to be generated by the lighting control console, the one or more digital control commands operable to be transmitted via data links to one or more lighting devices of the lighting system, the lighting control console including at least one housing in which one or more hardware components are arranged with protection against external influences, and wherein the lighting control console includes a plurality of operating elements, particularly keys, slide controls and/or rotary controls, which are arranged on an upper side of the housing and are operable for entering operating commands, and wherein the lighting control console includes at least one display device on which a user interface can be displayed, further including that the lighting control console is composed of at least two console modules, wherein each console module includes a plurality of electronic components including a hardware core and a hardware periphery connected to the hardware core, the hardware core including a first number of hardware components, and the hardware periphery including a second number of hardware components, and wherein the first number of hardware components of the hardware core in each of the console modules are essentially of identical construction to each of the first number of hardware components in each one of the at least two console modules, the hardware core of each of the at least two console modules is of identical construction in each case and includes at least one display device with at least one graphics processor of identical construction in each case connected thereto, wherein the at least one graphics processor is operable to calculate the video signals for the at least one display device, and wherein the at least one graphics processor belonging to the hardware core of the console modules, which calculates the video signals for the at least one display device, is integrated in a digital processor that serves for generating and managing a set of control commands and belongs to the hardware core of the console modules, wherein the digital processors in the console modules each have a display interface to which the display device can be connected.

2. The apparatus according to claim 1, wherein the hardware core of each of the console modules includes at least one microcontroller for generating and managing control commands, particularly control commands conforming to the DMX data protocol.

3. The apparatus according to claim 1, wherein the hardware core of each of the console modules includes at least one digital memory for storing control commands.

4. The apparatus according to claim 1, wherein the hardware core of each of the console modules includes at least one control command data interface, via which control command data can be transmitted to the lighting devices of the lighting system.

5. The apparatus according to claim 1, wherein the hardware core of each of the console modules includes at least one transfer data interface, via which the console modules can exchange transfer data with each other.

6. The apparatus according to claim 5, wherein the transfer data interface is configured in the form of a network interface, particularly in the form of an Ethernet network interface.

7. The apparatus according to claim 1, wherein the display device belonging to the hardware core of each of the console modules is designed in the manner of a color VGA monitor with a minimum resolution of 640×480 pixels, particularly in the manner of a flat panel monitor.

8. The apparatus according to claim 1, wherein the display device belonging to the hardware core of each of the console modules is designed in the manner of a touch-sensitive touch-screen.

9. The apparatus according to claim 1, wherein the hardware periphery in each of the console modules includes a plurality of operating elements, particularly keys, slide controls and/or rotary controls, as a user interface with which operating commands can be entered.

10. The apparatus according to claim 1, wherein the operating elements belonging to the hardware periphery are configured differently on at least two of the various console modules belonging to a lighting control console.

11. The apparatus according to claim 1, wherein at least two of the console modules that together form a lighting control console each have a separate housing, wherein each housing contains at least one hardware core and at least one hardware periphery.

12. The apparatus according to claim 1, wherein the housings of the console modules can be connected to one another mechanically with coupling elements to create the lighting control console.

13. An apparatus comprising:

a lighting control console for controlling a lighting system, wherein one or more digital control commands are operable to be generated by the lighting control console, the one or more digital control commands operable to be transmitted via data links to one or more lighting devices of the lighting system, the lighting control console including at least one housing in which one or more hardware components are arranged with protection against external influences, and wherein the lighting control console includes a plurality of operating elements, particularly keys, slide controls and/or rotary controls, which are arranged on an upper side of the housing and are operable for entering operating commands, and wherein the lighting control console includes at least one display device on which a user interface can be displayed, further including that the lighting control console is composed of at least two console modules, wherein each console module includes a plurality of electronic components including a hardware core and a hardware periphery connected to the hardware core, the hardware core including a first number of hardware components, and the hardware periphery including a second number of hardware components, and wherein the first number of hardware components of the hardware core in each of the console modules are essentially of identical construction to each of the first number of hardware components in each one of the at least two console modules, wherein a control computer is connected to one or more transfer data interfaces of the console modules, wherein a digital processor of the control computer can exchange transfer data with one or more other digital processors of the console modules via the transfer data interface, and wherein the control computer contains a graphics processor that calculates the video signals for an external monitor.

* * * * *